US007279626B2

(12) United States Patent
Draper et al.

(10) Patent No.: US 7,279,626 B2
(45) Date of Patent: Oct. 9, 2007

(54) SUSPENSION DEVICE FOR STRINGS ON A STRINGED INSTRUMENT

(76) Inventors: Jonathan Raven Draper, 4101 Goldfinch Dr., Richmond, VA (US) 23234; Roy Murray, 2416 Elmington Dr., Richmond, VA (US) 23238

( * ) Notice: Subject to any disclaimer, the term of this patent is extended or adjusted under 35 U.S.C. 154(b) by 121 days.

(21) Appl. No.: 11/232,185

(22) Filed: Sep. 21, 2005

(65) Prior Publication Data

US 2006/0060059 A1 Mar. 23, 2006

Related U.S. Application Data

(60) Provisional application No. 60/611,595, filed on Sep. 21, 2004.

(51) Int. Cl.
*G10D 3/04* (2006.01)

(52) U.S. Cl. ..... 84/298; 84/307

(58) Field of Classification Search ..... 84/298, 84/297, 299, 307, 308, 188, 209, 213, 214
See application file for complete search history.

(56) References Cited

U.S. PATENT DOCUMENTS 3,896,695 A 7/1975 Kingsbury
4,230,014 A 10/1980 Hoshino
4,433,605 A 2/1984 Matsui
4,807,508 A 2/1989 Yairi
4,840,103 A 6/1989 Mayer
5,140,884 A 8/1992 Bowden
5,173,565 A 12/1992 Gunn
5,208,410 A 5/1993 Foley
5,477,764 A 12/1995 Carrico
5,686,677 A 11/1997 Herbert
5,939,653 A 8/1999 Chang
6,124,536 A 9/2000 Hoshino
6,133,515 A 10/2000 Hoshino
2002/0092404 A1* 7/2002 Naimish ..... 84/298
2003/0177883 A1* 9/2003 Rose et al. ..... 84/298

FOREIGN PATENT DOCUMENTS

DE 4019383 1/1991

* cited by examiner

*Primary Examiner*—Lincoln Donovan
*Assistant Examiner*—Jianchun Qin
(74) *Attorney, Agent, or Firm*—John H. Thomas, P.C.

(57) ABSTRACT

The invention relates to an suspension apparatus for mounting a string on a stringed instrument. The apparatus has a base plate secured to the instrument, a shuttle slidably attached to the base plate, a saddle base attached to the shuttle and positionably adjustable relative to the shuttle, and a saddle. A string passes through the saddle wherein the saddle is height adjustable relative to the base plate, whereby the suspension apparatus is operable to adjust a string in three different directions.

18 Claims, 4 Drawing Sheets

SUSPENSION DEVICE FOR STRINGS ON A STRINGED INSTRUMENT

This application claims the benefit of U.S. Provisional Application Ser. No. 60/611,595, filed Sep. 21, 2004.

The present invention relates to a suspension device for strings on a stringed instrument. Specifically, the suspension device allows for fine tuning or movement of a string saddle in three different directions.

BACKGROUND

Stringed instruments and specifically the engineering associated with all of the string connections and tuning mechanisms have been the subject of substantial research and attention. An important part on a stringed instrument is the point where the string contacts that instrument. This is an important point because it the point where the string contacts the rest of the stringed instrument determines the way the string creates its wave forms and, thus, sound. There are many known constructions that provide for a musician to adjust or move that contact point. However, each of these prior devices have limitations.

It is known that by moving the contact points along the length of the string, the intonation or wave form is manipulated. Similarly, moving the string side to side in a lateral fashion is known in order to adjust the alignment of a string over pick ups in an electrical instrument such as an electric guitar. Finally, it is known for devices to allow a musician to move the string in the contact point up and down or away from or towards the surface of the instrument in order to obtain a desired action or pressure on the strings. A drawback of existing devices, however, is that they do not allow for the variability with respect to movement of the contact point in all of these directions.

SUMMARY

Accordingly, as an object to the present invention to overcome the foregoing or other drawbacks, including ease of use, and provide a suspension device that allows for a full range, three dimensional adjustability of contact points for strings on a stringed instrument. This full range of adjustability allows a musician to thoroughly customize the instrument that they are using.

In one example, a stringed musical instrument comprises at least one string mounted in a substantially straight line on the instrument. The instrument further comprises a suspension device on which the string is mounted. The suspension device comprises a saddle that contacts the string, a saddle base that incorporates the saddle, a shuttle that is slidably attached to the saddle base, and a base plate that is slidably attached to the shuttle and that is further fixed to a surface of the instrument. The shuttle is movable on the base plate in a direction either substantially parallel to or perpendicular to the line defined by the string and the saddle base is moveable on the shuttle in a direction either substantially parallel to or perpendicular to the line defined by the string. The movable direction of the shuttle is perpendicular to the moveable direction of the saddle base. Further, the saddle base comprises means for adjusting the saddle in a direction substantially normal to the base plate. As a result, the saddle may be moved with respect to the instrument in three different directions.

The foregoing stringed instrument may further comprise a plurality of strings and an equal plurality of saddles with one string contacting each saddle. Each saddle is then incorporated into one of an equal plurality of saddle bases and each saddle base is slidingly attached to one of an equal plurality of shuttles. The stringed instrument may be a guitar comprising a body and the base plate is fixed to the surface of the body. The means for adjusting the saddle in a direction substantially normal to the base plate may comprise a pair of threaded shafts connected to the saddle, wherein the pair of threaded shafts may be turned to move the saddle in a direction substantially normal to the base plate. The shuttle may comprise a brake that releasably fixes the shuttle to the base plate.

DETAILED DESCRIPTION

The suspension device for strings on a stringed instrument of the present invention efficiently addresses one or more shortcomings of the prior art, including the lack of a known apparatus that is operable to adjust a string position in three dimensions. The present system is adapted to account for a variety of string adjustment mechanisms.

FIGS. 1 through 5 illustrate one or more preferred embodiments of the present invention. Naturally, an engineer having ordinary skill with the suspension devices of stringed instruments will be able to create a string suspension device that incorporates the teachings of the present invention, but which may look different and incorporate different, alternative parts. The ability to create a three-dimensionally adjustable suspension device makes the present invention very efficient and very different from existing stringed instrument suspension devices.

Figure 1:
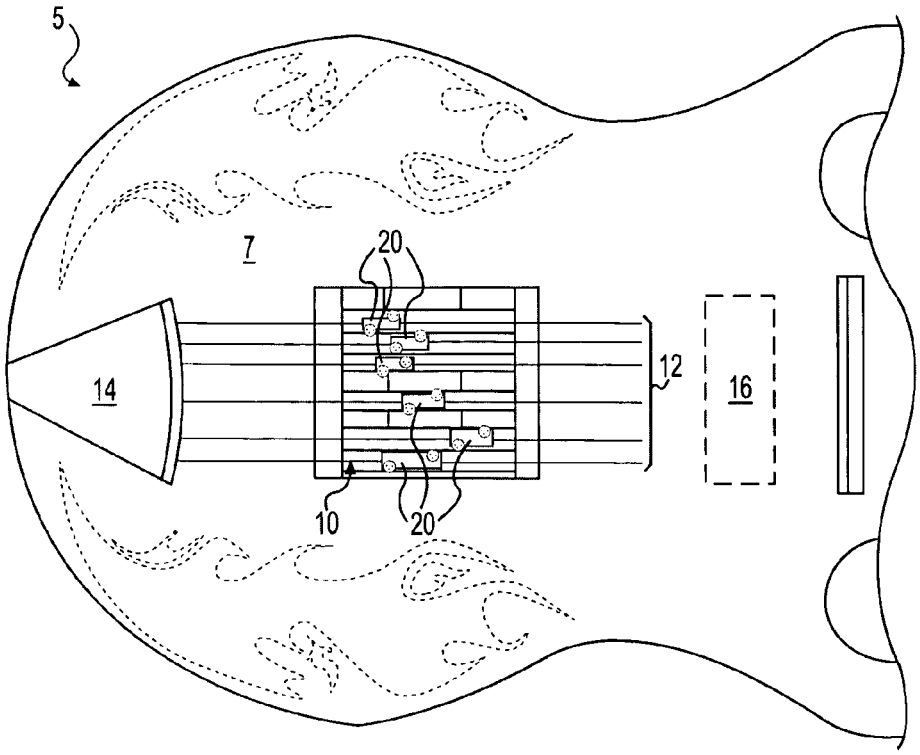
FIG. 1 is a top-down perspective view of a musical instrument with a suspension device for the instrument's strings in accordance with one embodiment of the invention.
Figure 2:
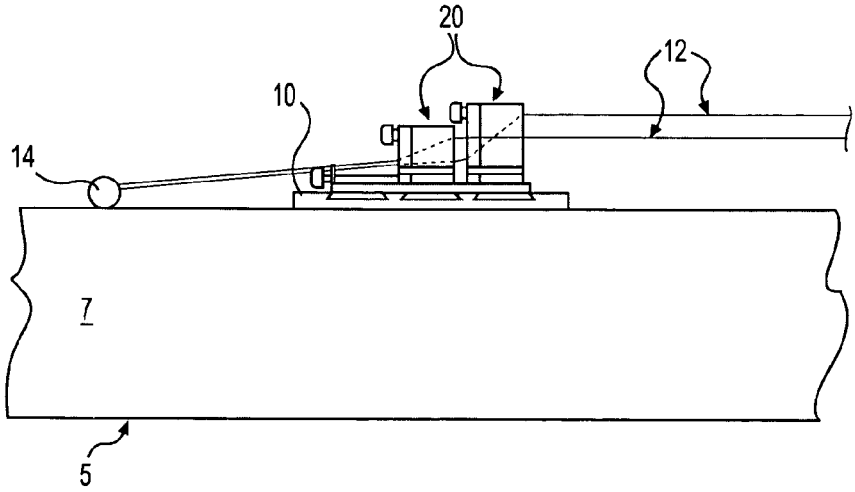
FIG. 2 is side view thereof.

Turning to FIGS. 1 and 2, there is illustrated a musical instrument 5, such as a guitar, with a suspension device 10 operable to adjust a plurality of strings 12 on the instrument 5. Stringed instruments generally have a body 7 and a neck (not shown). The strings on a stringed instrument are typically anchored at the end of the neck opposite the body. The neck may or may not include frets, which are metal bars that the musician places the strings against. The strings are stretched from the neck anchor to a body string anchor 14.

A pickup 16 is an electromagnet housed underneath strings 12 on an electric guitar or other electric stringed instrument. Pickup 16 converts the motion of strings 12, or the wave forms caused thereby, into a signal that can then be electrically amplified and modified. Pickup 16 is shown in broken lines as it is optional. Non-electric instruments will generally not have a pickup.

As will be explained in further detail below, suspension device 10 includes a plurality of saddles 20 through which strings 12 are passed. Saddles 20 are adjustable in three dimensions so that the tension and position of strings 12 are similarly adjusted in three directions. Device 10 provides a side-to-side adjustment (relative to the width of the instrument body 7) in order align strings 12 over pickup 16 or to create or minimize spacing between strings based on the instrument player's preferences. A front-to-back adjustment changes the intonation produced by a string. In addition, strings 12 can be adjusted up-and-down relative to body 7 and the neck to modify the "action" or pressure required to place the strings onto the frets. Overall, certain characteristics of a stringed instrument are easily modified by adjusting where the instrument's strings contact that instrument. Any adjustments will likely change the way a string(s) creates wave forms. Some adjustments will be helpful in order to conform the instrument's characteristics to the preferences of the instrument's player.

FIG. 1 illustrates a top-down view of strings on a stringed instrument wherein suspension device 10 has been laterally adjusted so that the distances between the various strings in the plurality of springs 12 are not equidistant (i.e., certain strings are closer to the strings adjacent to that string than other strings are). It can also be seen that saddles 20 have been adjusted in a front-to-back manner so that saddles 20 are not equidistant from pickup 16 or anchor 14. Likewise, in FIG. 2, it can be seen that individual strings have been adjusted so that the strings are not all equidistant from instrument body 7. Certain strings have been adjusted so as to be farther from body 7 relative to other strings. From this side view, it can be seen that saddles 20 are operable to adjust the height and length contact point with instrument 5.

Figure 3:
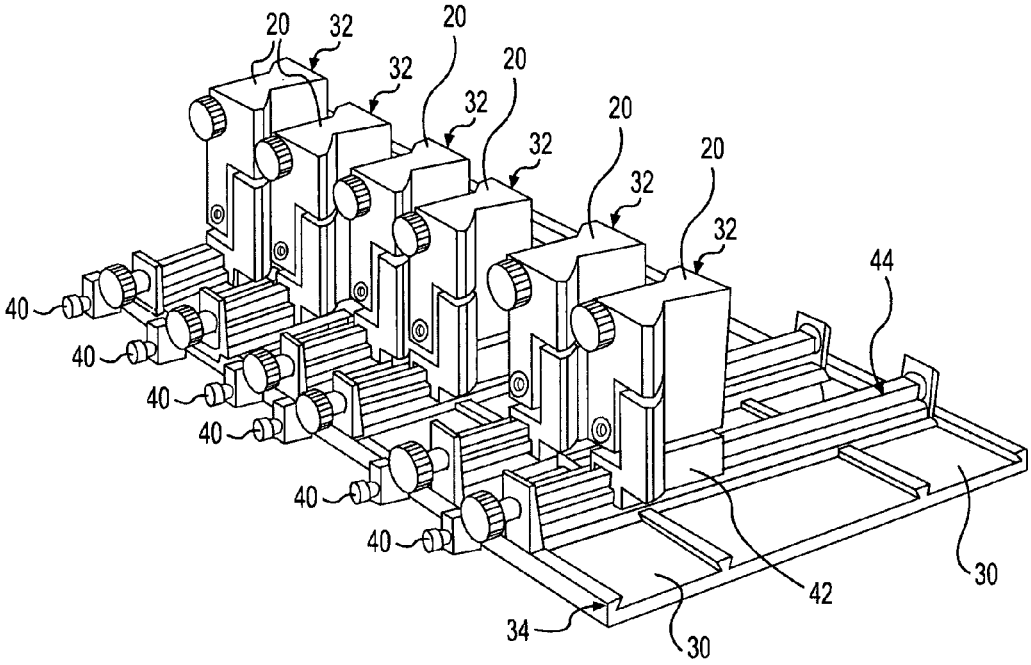
FIG. 3 is a perspective view of the suspension device for strings on a stringed instrument in accordance with one embodiment of the present invention.
Figure 4:
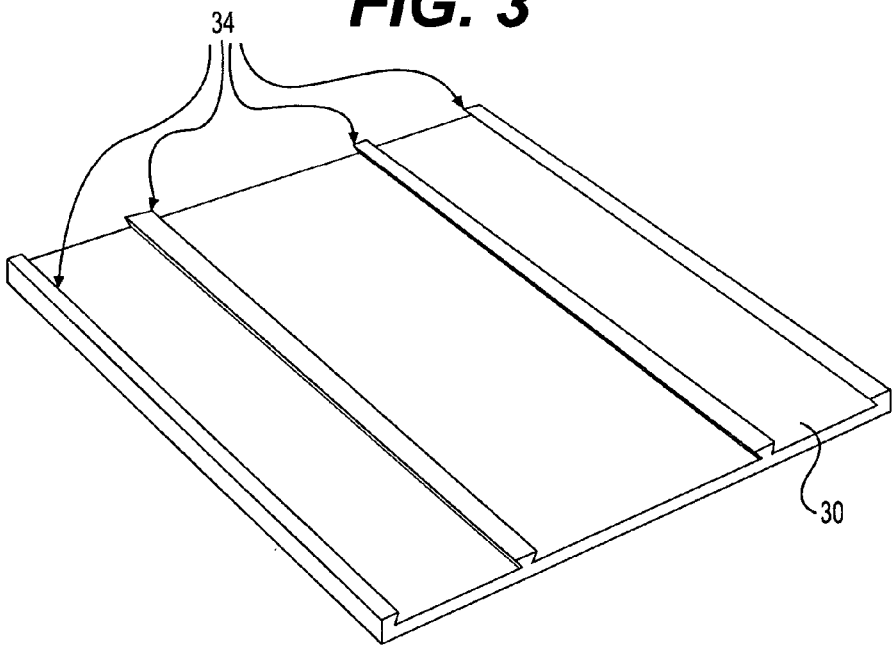
FIG. 4 is a perspective view of a base plate for use with the suspension device of the present invention.

Having an overview now of device 10, the suspension device 10 is illustrated in further detail in FIGS. 3 and 4. A base plate 30 supports a number of saddle assemblies 32. Base plate 30 is secured to instrument body 7 through any fastening mechanism, such as fasteners (screws, rivets, or the like), adhesives, or other mechanisms known in the art. Similarly, base plate 30 can comprise any suitable material for a stringed instrument suspension such as metal, wood, plastic, or the like. Base plate 30 provides dovetailed ridges or supports 34 in order to slidably engage assemblies 32. The specific shape and mechanism used to slidably engage the assemblies can be modified, as would be obvious to one of skill in the art.

Figure 5:
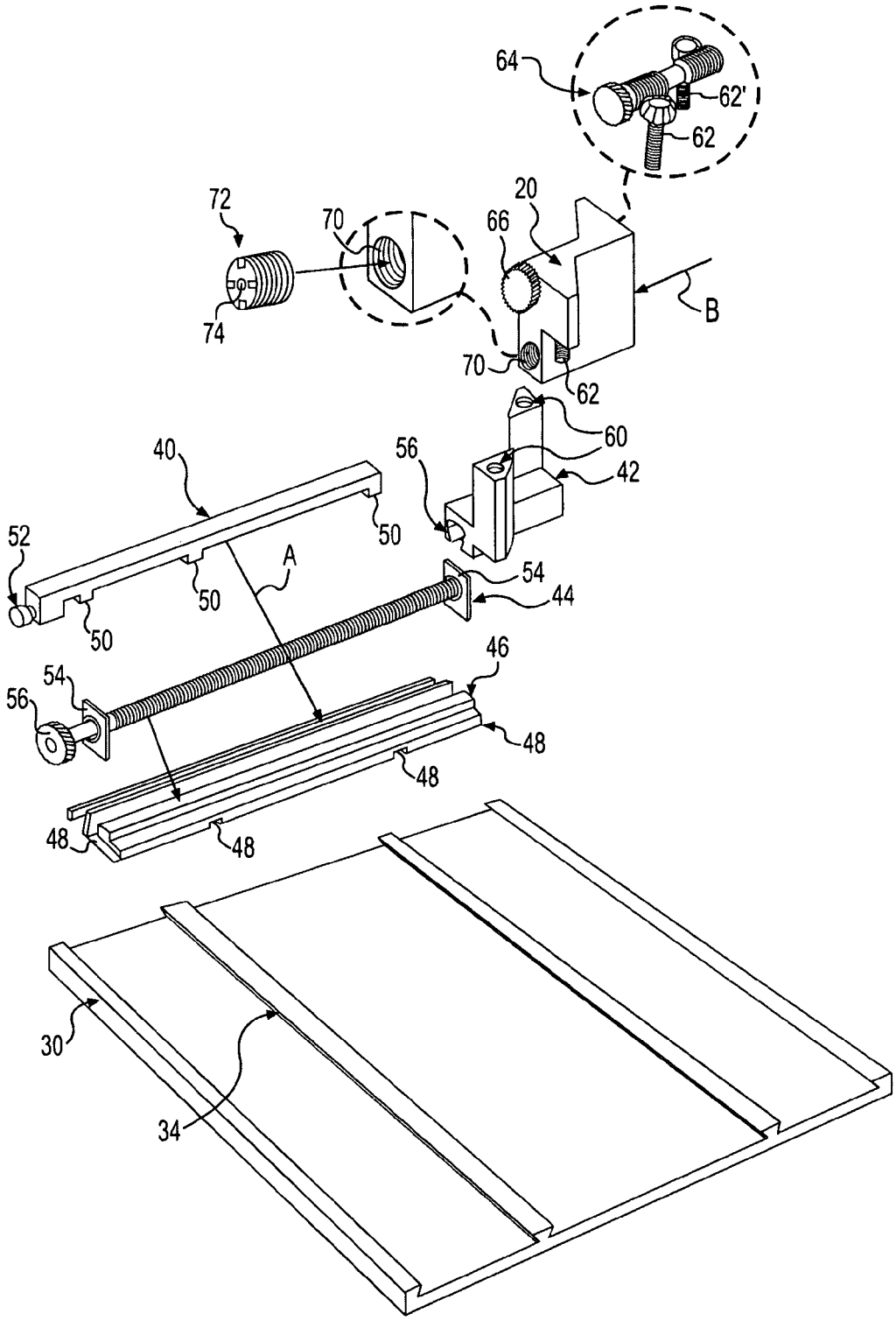
FIG. 5 is a view of the parts of the suspension device of the present invention in spaced relationships with the corresponding parts of the invention in accordance with one embodiment of the present invention.

FIG. 5 illustrates one full saddle assembly wherein the respective parts of the assembly are shown in spaced relationships to each other and to base plate 30. The larger components include a brake 40, a saddle base 42, saddle 20, a threaded rod 44, and a shuttle 46. Closeup views of particular portions of the saddle assembly are integrated into FIG. 5, as will be discussed further below.

Shuttle 46 is cut or otherwise formed to include notches 48 to correspond to supports 34 on base plate 30. Therefore, shuttle 46 simply slides onto base plate 30 in a manner that secures shuttle 46 to base plate 30. It is desirable to be able to fix shuttle 46 in place after adjusting the shuttle to a specific location on base plate 30 pending additional adjustments. To that end, brake 40 fits into shuttle 46 in a channel indicated by directional arrow 'A'. The channel would have openings that allow brake 40 to extend downward through the bottom of shuttle 46 in order to engage base dovetails 34 via a series of nubs 50 on shuttle 46. A brake screw 52 can be actuated to pull nubs 50 into a frictional engagement with dovetails 34 in order to arrest lateral movement of shuttle 46 on base plate 30. In this manner, selective lateral adjustments of saddles 20, which are supported on shuttle 46, relative to instrument body 7, can be selectively accomplished.

Saddles 20 can also be selectively adjusted in the lengthwise direction of the instrument's body 7 and neck. To achieve this adjustment, threaded rod or shaft 44 is provided with end plates 54 that are placed at the distal ends of shuttle 46 but atop the end walls of base plate 30. It is also envisioned that end plates 54 can be held between the ends of shuttle 46 and the base sidewalls. The end plates are either frictionally held onto shuttle 46 or a fastening mechanism (fasteners, screws, adhesives, etc.) is employed to hold the rod 44 on shuttle 46. Regardless of the anchoring mechanism, the end plates effectively hold threaded rod 44 above the shuttle 46 sliding the shuttle along base plate 30 will also move rod 44.

Saddle base 42 includes a threaded channel 56 that corresponds to rod 44. In other words, saddle base 42 (and thus saddle 20) are thread onto the rod that is in turn anchored to the shuttle. Rotating rod knob 56 turns rod 44. Threaded channel 56 converts this rotation into forward or back motion along the length of the rod. The end plates provide "stops" that keep tower 42 on rod 44. Overall, the saddle base is positionally adjustable relative to the shuttle. Other adjustment mechanisms for the adjustment will be obvious to one of skill in the art.

The vertical adjustment of saddle 20 is achieved through the mechanical connection of saddle 20 to saddle base 42. Saddle base 42 includes two vertically extending (relative to base plate 30) columns 60 that are threaded. Each threaded column 60 engage downwardly protruding screws 62, 62' provided by a worm gear mechanism 64 in saddle 20. Because screws 62, 62' are on opposite sides of worm gear 64, columns 60 are threaded in reverse directions of one another. A user simply rotates gear knob 66 to actuate worm gear 64. The rotation of the worm gear simultaneously moves screws 62, 62' either upwardly or downwardly in columns 60.

Located under worm gear 64 in saddle 20 is a string receptacle 70. The receptacle is basically an aperture or void extending from the face of saddle 20 (indicated by the directional arrow 'B') out the rear of saddle 20. A string is inserted into receptacle so that it enters saddle 20 at a higher point than it exits (see FIG. 2). The entry and exit apertures can be generically sized to accept conventional or unconventional string sizes.

In another preferred embodiment, it is envisioned that each entry and exit opening is threaded to accept a threaded string holder 72 (only rearwardly facing exit is illustrated in FIG. 5). Holder 72 includes a holder aperture 74. Holders 72 can be made of various materials to be selected by the musician. The material used for holders 74 may have an impact on the tone characteristics produced by instrument 5.

Figure 6:
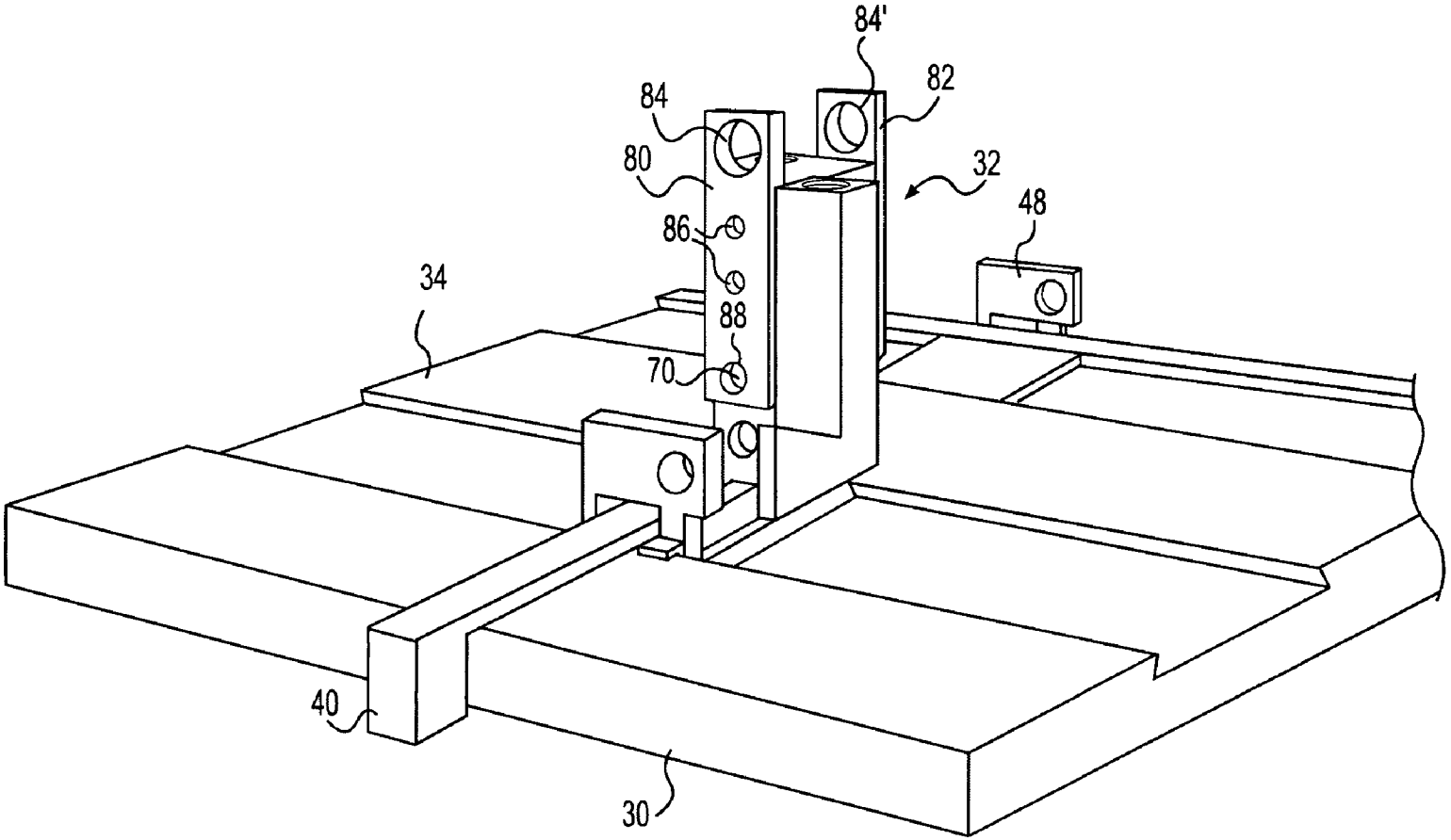
FIG. 6 is a perspective view of an alternate preferred embodiment of the suspension device.

In yet another preferred embodiment, illustrated in FIG. 6, worm gear 64 is not integrated into saddle 20. Although several components have been deleted for this simplified illustration of device 10, it can be seen that rear and front face plates, identified as elements 80 and 82, respectively, have been added to saddle assembly 32. Each plate includes apertures 86 for fasteners to secure the plates to the saddle and/or saddle base. Rear plate 80 includes a lower string exit hole 88. The string entry hole would be provided on front plate 82.

The embodiment including rear plate 80 and front plate 82 would also include the worm gear. Worm knob 66 would be situated in rear worm opening 84. The end of the worm gear opposite the knob would extend through front worm opening 84'. A cap or other stop would be secured to the end of the worm gear in order to hold the gear in place. The threaded shafts 62, 62' that are mechanically rotated via the worm gear would extend through the saddle/string receptacle into the saddle base in order to move the string receptacle relative to the saddle base. In this unexploded view, the saddle base and the saddle are not clearly distinguished. It should also be noted that a plate can be inserted atop the saddle and beneath the worm gear. Threaded apertures would allow the threaded shafts 62, 62' to pass through the plate and into the saddle. This plate would be fixed to the non-moving front and rear plates. Therefore, the string receptacle could be adjusted relative to the inserted plate. The threaded shafts could terminate within the saddle or within the saddle base. The front and rear plates could be made of various materials. They would interchangeable, in one preferred embodiment, so that the musician could select the type of material for the plates as they are in contact with the strings.

In use, the entire suspension device 10 is secured to an instrument with the strings threaded through the saddle. A user rotates gear knob 66 to raise or lower saddle 20 relative to base plate 30. Saddle 20 is moved in the lengthwise direction of the instrument by rotating knob 56. This causes a positional adjustment of the saddle base relative to the shuttle. Lateral adjustments are made by sliding shuttle 46 along supports 34 on base plate 30. Brake 40 fixes the shuttle in place following the lateral adjustment of saddle 20. In this way, the instrument's strings can be adjusted in three directions via suspension device 10.

It should be understood that the base plate may be oriented at a number of directions relative to the direction of the strings on the stringed instrument. For this reason, shuttle is technically movable on the base plate in a direction either substantially parallel to or perpendicular to the line defined by the string and the saddle base is moveable on the shuttle in a direction either substantially parallel to or perpendicular to the line defined by the string. Other base plate orientations are available as well. The movable direction of the shuttle is perpendicular to the moveable direction of the saddle base. Further, the saddle base comprises means for adjusting the saddle in a direction substantially normal to the base plate. As a result, the saddle may be moved with respect to the instrument in three different directions.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A stringed musical instrument comprising at least one string mounted in a substantially straight line on the instrument, the instrument further comprising a suspension device through which the string is mounted, wherein the suspension device comprises:

a saddle, the string passing through the saddle;

a saddle base that incorporates the saddle;

a shuttle, the saddle base adjustably positioned on the shuttle;

a base plate that is slidably attached to the shuttle and that is further fixed to a surface of the instrument;

wherein the shuttle is movable on the base plate in a direction substantially perpendicular to the line defined by the string and the saddle base is movable on the shuttle in a direction substantially parallel to the line defined by the string, the movement of the saddle base occurring relative to the shuttle, and further wherein the movable direction of the shuttle is perpendicular to the movable direction of the saddle base; and further wherein the saddle includes a height adjustment mechanism for adjusting the saddle in a direction substantially normal to the base plate, whereby the saddle is adjustable with respect to the instrument in three different directions.

2. A stringed instrument as described in claim 1, further comprising a plurality of strings and an equal plurality of saddles with one string contained by each saddle, each saddle incorporated onto one of an equal plurality of saddle bases, and each saddle base slidingly attached to one of an equal plurality of shuttles.

3. A stringed instrument as described in claim 1, wherein the stringed instrument is a guitar comprising a body and the base plate is fixed to the surface of the body.

4. A stringed instrument as described in claim 1, wherein the height adjustment mechanism for adjusting the saddle in a direction substantially normal to the base plate comprises at least one threaded shaft connected to the saddle, wherein the at least one threaded shaft is rotated to move the saddle in a direction substantially normal to the base plate.

5. A stringed instrument as described in claim 4, wherein the saddle comprises a string receptacle mounted on the saddle base, the saddle base providing at least one treaded column, wherein the at least one threaded shaft connects to a corresponding threaded column, and wherein when rotation of the treaded shafts causes the string receptacle and saddle base to move in relation to each other.

6. A stringed instrument as described in claim 1, the shuttle further comprising a brake that selectively fixes the shuttle to the base plate.

7. A stringed instrument as described in claim 1, further comprising a threaded rod mounted on the shuttle, the saddle base including a threaded channel engaging the treaded rod, wherein the saddle base is adjustably positioned on the shuttle by rotation of the threaded rod.

8. A stringed instrument as described in claim 1, wherein the height adjustment mechanism for adjusting the saddle in a direction substantially normal to the base plate comprises a worm gear provided by the saddle, whereby actuation of the worm gear causes at least one threaded shaft connected to the worm gear to rotate within a threaded column provided by the saddle base.

9. A stringed instrument as described in claim 1, wherein the string is in contact with a string holder, the string holder selectively secured into the saddle.

10. A stringed instrument as described in claim 1, further comprising a front plate and rear plate selectively connected to a first side and a second opposing side of the saddle, respectively, wherein the string is in contact with the front plate and rear plate, the height adjustment mechanism held by the front plate and rear plate.

11. A stringed musical instrument comprising a body, a neck and at least one string mounted to the neck and body, the instrument further comprising:

a suspension device on which the at least one string is mounted, the suspension device including a saddle with a string receptacle and incorporating a height adjustment mechanism, the at least one string passing through said saddle via said receptacle, a saddle base, the saddle mounted on said saddle base, a shuttle, the saddle base adjustably positioned on the shuttle, a base plate, the shuttle slidably mounted on the base plate, the base plate further fixed to a surface of the instrument;

wherein the height adjustment mechanism adjusts the saddle in a direction substantially normal to the base plate, the height adjustment mechanism comprising a worm gear, whereby actuation of the worm gear causes at least one threaded shaft connected to the worm gear to rotate within a threaded column provided by the saddle base; and whereby the saddle is adjustable with respect to the instrument in three different directions.

12. A stringed instrument as described in claim 11, further comprising a plurality of strings and a plurality of saddles, each string in the plurality of strings corresponding to one saddle in the plurality of saddles, each saddle incorporated onto one of an equal plurality of saddle bases, and each saddle base attached to one of an equal plurality of shuttles.

13. A stringed instrument as described in claim 12, wherein each shuttle is slidably attached to a single base plate.

14. A stringed instrument as described in claim 11, wherein the shuttle includes a brake that selectively holds the shuttle to the base plate.

15. A stringed instrument as described in claim 14, wherein the brake includes a brake screw, whereby actuating the brake screw selectively engages the brake to the base plate.

16. A stringed instrument as described in claim 11, further comprising a threaded rod mounted on the shuttle, the saddle base including a threaded channel engaging the threaded rod, whereby the saddle base is adjustably positioned on the shuttle by rotation of the threaded rod.

17. A stringed instrument as described in claim 11, wherein the string is in contact with a string holder, the string holder selectively secured into the saddle.

18. A stringed instrument as described in claim 11, further comprising a front plate and rear plate selectively connected to a first side and a second opposing side of the saddle, respectively, wherein the string is in contact with the front plate and rear plate, the height adjustment mechanism held by the front plate and rear plate.

* * * * *